United States Patent [19]

Imazu

[11] 4,254,825

[45] Mar. 10, 1981

[54] MULTITUBULAR HEAT EXCHANGER

[75] Inventor: Syuichi Imazu, Hitachi, Japan

[73] Assignee: Hitachi, Ltd., Tokyo, Japan

[21] Appl. No.: 81,358

[22] Filed: Oct. 3, 1979

[30] Foreign Application Priority Data

Oct. 5, 1978 [JP] Japan ..... 53-121967

[51] Int. Cl.[3] ..... F28B 9/10; F28F 9/22

[52] U.S. Cl. ..... 165/114; 122/441; 165/134 R; 165/160; 165/163

[58] Field of Search ..... 122/32, 441; 165/110, 165/111, 114, 134, 160, 161, 163, 176

[56] References Cited

U.S. PATENT DOCUMENTS

| | | | |
|---|---|---|---|
| 1,764,716 | 6/1930 | Ehrhart | 165/112 |
| 2,180,840 | 11/1939 | Tuley et al. | 165/114 |
| 3,349,841 | 10/1967 | Stoker | 165/114 |
| 3,795,273 | 3/1974 | Brigida et al. | 122/441 |
| 3,938,588 | 2/1976 | Coit et al. | 122/441 |

FOREIGN PATENT DOCUMENTS

| | | | |
|---|---|---|---|
| 53-27705 | 3/1978 | Japan | 165/114 |

OTHER PUBLICATIONS

"Operational Experience with Heat Exchangers in Nuclear Power Stations with Light Water Reactors", by H. Baschek and E. Kocouiek, Combustion, 9-75, pp. 14-23.

*Primary Examiner*—Sheldon Richter
*Attorney, Agent, or Firm*—Craig and Antonelli

[57] ABSTRACT

A multitubular heat exchanger used as a feedwater heater in a power generating plant and the like includes a shell, a high temperature tube bundle and a low temperature tube bundle composed of a multiplicity of U-shaped heat transfer tubes arranged in the shell and a vent tube interposed between the two tube bundles. A laterally-closed flow passage is defined in at least one of the high temperature tube bundle and the low temperature tube bundle to induce part of a heating medium flowing between the shell and the tube bundle to flow to a position deep in the tube bundle and near the vent tube, so that a noncondensable gas stagnating zone formed in the tube bundle can be moved near to the vent tube and noncondensable gas can be removed from the shell by extraction through the vent tube.

10 Claims, 6 Drawing Figures

MULTITUBULAR HEAT EXCHANGER

BACKGROUND OF THE INVENTION

1. Field of the Invention

This invention relates to multitubular heat exchangers and more particularly to a multitubular heat exchanger of the type used in a power generating plant and the like as a feedwater heater handling large volumes of steam and wet steam.

2. Description of the Prior Art

This type of heat exchangers generally comprises a shell, a heating medium inlet formed in the shell, a high temperature tube bundle and a low temperature tube bundle located within the shell and formed by a large number of U-shaped heat transfer tubes for permitting a medium to be heated to flow therethrough so that heat exchange may take place between the medium to be heated and a heating medium introduced into the interior of the shell through the heating medium inlet, and a vent tube interposed between the high temperature tube bundle and the low temperature tube bundle and arranged in the longitudinal direction of the shell for removing noncondensable gas from the interior of the shell. In the aforesaid type of heat exchanger, the ratio of the heat exchanged in the low temperature tube bundle or the tube bundle located near the inlet for medium to be heated to the amount of heat exchanged in the high temperature tube bundle or the tube bundle located near the heated medium outlet has hitherto been about 15:1. This difference in the amount of heat exchanged has given rise to the problem that noncondensable gas of the heating medium accumulates and a stagnating zone of the noncondensable gas is created in the central or deep portion of the low temperature tube bundle in which terminal ends of streams of the heating medium are mainly concentrated. The presence of the noncondensable gas stagnating zone has the disadvantage that it constitutes a portion of the heat exchanger wherein no heat exchange takes place and greatly reduces the performance of the heat exchanger. Also, the noncondensable gas in the noncondensable gas stagnating zone cannot be removed from the interior of the shell through the vent tube interposed between the high and low tube bundles to avoid trouble, so that the presence of the noncondensable gas stagnating zone has the disadvantage of causing corrosion of the heat transfer tubes to occur.

As one of the measures to cope with the above-mentioned problems, Japanese Laid-Open Patent Publication No. 27705/78 laid open for public inspection on Mar. 13, 1978 (this patent publication corresponding to the U.S. patent application, Ser. No. 823,655) proposes to provide at least one flow guide plate on the outer periphery side of at least the low temperature tube bundle for inducing streams of the heating medium flowing between the shell and the tube bundles to pass on to the vent tube. The flow guide plate provided in the prior art as described hereinabove is intended to facilitate the removal of the stagnating noncondensable gas through the vent tube by specifically reducing the size of the noncondensable gas stagnating zone formed in the central portion of the low temperature tube bundle and at the same time moving the zone toward the vent tube.

However, the provision of the flow guide plate has been found to be unable to achieve the meritorious effect of avoiding formation of the noncondensable gas stagnating zone when a heat exchanger is of a large capacity and its tube bundles are of large dimensions.

SUMMARY OF THE INVENTION

An object of the present invention is to provide a multitubular heat exchanger capable of satisfactorily avoiding stagnation of noncondensable gas of heating medium, to thereby improve heat exchange performance and avoid corrosion of heat transfer tubes.

Another object is to provide a multitubular heat exchanger provided with means for separating and leading to a predetermined position in a tube bundle, drain contained in a heating medium introduced into the heat exchanger, to thereby improve heat exchange performance.

According to a general aspect of the present invention, the multitubular heat exchanger of the type described is improved to comprise means for defining at least one laterally-closed flow passage in at least one of the tube bundles, the flow passage inducing therethrough a part of the heating medium flowing between the shell and the tube bundles to an inner deep part of the at least one tube bundle.

The above and other objects as well as the characteristic features of the invention will become more apparent from the following description when read in conjunction with the accompanying drawings.

BRIEF DESCRIPTION OF THE DRAWINGS

Identical or similar parts are designated by like reference characters throughout the drawings.

DESCRIPTION OF THE PREFERRED EMBODIMENTS

Figure 1:
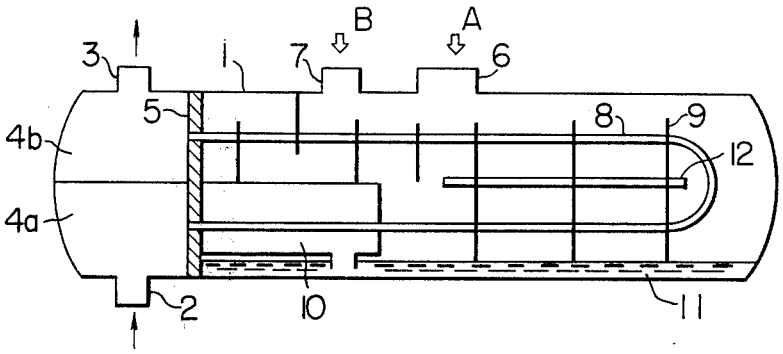
FIG. 1 PRIOR ART
FIG. 1 is a vertical sectional view in explanation of a multitubular heat exchanger of the dual shell type of the prior art constructed as a feedwater heater.
Figure 2:
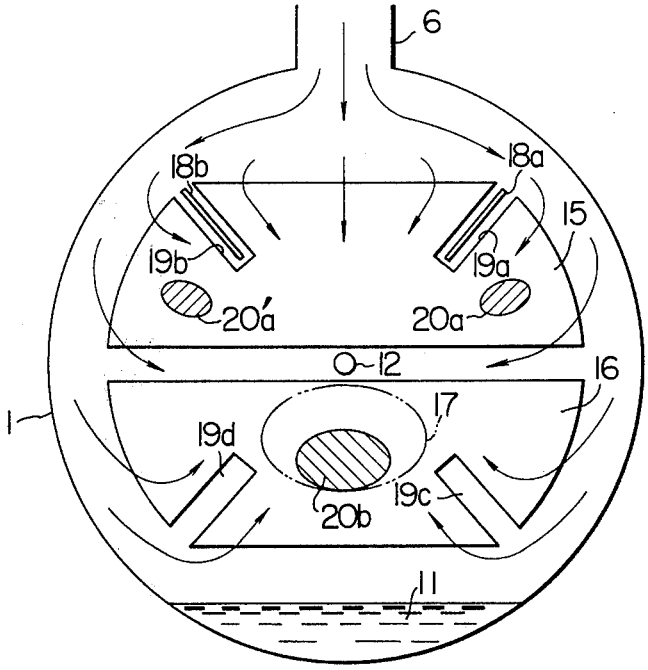
FIG. 2 PRIOR ART
FIG. 2 is a transverse sectional view of the heat exchanger shown in FIG. 1.

Referring to FIGS. 1 and 2, a multitubular heat exchanger of the dual shell type of the prior art constructed as a feedwater heater shown therein comprises a shell 1 formed therein with a steam inlet port 6 for admitting extracted steam A from a turbine, not shown, and a drain inlet port 7 for admitting drain B from a high-pressure side heater, not shown. Installed in the shell 1 are a large number of U-shaped heat transfer tubes 8 allowing feedwater, which is a medium to be heated, to flow therethrough, the heat transfer tubes 8 constituting tube bundles 15 and 16. Interposed between the upper tube bundle or high temperature tube bundle 15 and the lower tube bundle or low temperature tube bundle 16 is a vent tube 12 for removing noncondensable gas from the interior of the shell 1.

Steam admitted through the steam inlet port 6 to the interior of the shell 1 flows, as indicated by arrows in FIG. 2, into the tube bundles 15 and 16 to impart heat to feedwater flowing through the heat transfer tubes 8. The steam converted into condensation as the result of the heat exchange collects as drain 11 on the bottom of the shell 1, the drain 11 being released from the shell 1 after being cooled by a drain cooler 10. In FIG. 1, numerals 2 and 4*a* designate a feedwater inlet and a feedwater inlet side water box, respectively, while 3 and 4*b* designate a feedwater outlet and a feedwater outlet side water box, respectively. 5 is a tube plate.

The heat exchanger shown in FIGS. 1 and 2 has, provided in the high temperature tube bundle 15, the flow guide plate described in Japanese Laid-Open Patent Publication No. 27705/78 referred to in the background of the invention, and is therefore based on the same technical concept as the invention disclosed therein. More specifically, slits 19*a* to 19*d* are formed in the tube bundles 15 and 16, and flow guide plates 18*a* and 18*b* are mounted only in those slits which are disposed in the high temperature tube bundle 15. The provision of the slits and the flow guide plates has the effect of improving the flow condition of steam through the tube bundles 15 and 16 and minimizing the size of a zone wherein no heat exchange takes place or a noncondensable gas stagnating zone which would be formed in the tube bundles 15 and 16. However, it is impossible for this arrangement to achieve sufficiently the aforesaid effect when the arrangement is applied to a heat exchanger of high capacity provided with tube bundles of large size composed of several thousands of heat transfer tubes. That is, in the case of a heat exchanger of large size, a noncondensable gas stagnating zone 20*b* of relatively large size is still formed in a deep portion of the low temperature tube bundle 16 near the center thereof, and noncondensable gas stagnating zones 20*a* and 20*a*′ are formed in positions at the back of the flow guide plates 18*a* and 18*b* respectively.

Generally, a noncondensable gas stagnating zone tends to be formed in a deep portion of the low temperature tube bundle 16 near the center thereof for the reason presently to be described. Steam flowing downwardly along the outer peripheries of the tube bundles 15 and 16 does not preferably change its direction to flow upwardly once it has reached the level of the drain 11 at the bottom of the shell, so that this portion of steam is prevented from flowing around the tube bundles 16 to effect heat exchange satisfactorily. Therefore, the noncondensable gas stagnating zone 17 of large size is produced near the center of the tube bundle 16 as described hereinabove unless the aforesaid slits are provided. When the slits 19*c* and 19*d* are provided as shown in FIG. 2, steam is led through the slits 19*c* and 19*d* to the interior of the tube bundle 16 so that the size of the stagnating zone is reduced. However, it has been found that the steam flowing in streams along the slits 19*c* and 19*d* is diffused or diverted toward the lateral sides of the slits 19*c* and 19*d* midway in its flow toward the center of the tube bundle 16. As a result, the steam has reduced energy or pressure when it reaches the inner end of each of the slits 19*c* and 19*d*, the energy of the steam being so reduced that is impossible to force the stagnating zone to move to the position of the vent tube 12. Thus the stagnating zone 20*b* still exists near the center of the low temperature tube bundle 16.

Formation of the stagnating zones 20*a* and 20*a*′ in the high temperature tube bundle 15 would be attributed to inability of steam to flow smoothly to the positions of the zones 20*a* and 20′ because of the blocking action of the flow guide plates 18*a* and 18*b* which prevents downwardly flowing streams of steam from flowing to the positions of the zones 18*a* and 18*b*. The positions in which the stagnating zones 18*a* and 18*b* are formed have a large depth as measured from the outer periphery of the tube bundle 15 toward the vent tube 12, and a stagnating zone tends to be formed in any of such positions. Since an inflow of steam to such positions is prevented from occurring as aforesaid, the stagnating zones 20*a* and 20*a*′ are created. As aforesaid, the slits 19*a* and 19*b* in the tube bundle 15 are provided with the flow guide plates 18*a* and 18*b* respectively. However, steam flowing in streams along these flow guide plates into the central portion of the tube bundle 15 is diffused sideways during its flow, so that the steam does not have energy high enough to eliminate the stagnating zones 20*a* and 20*a*′ when the steam has reached the inner end of each of the flow guide plates 18*a* and 18*b*.

The present invention has been developed for the purpose of obviating the aforesaid disadvantages of the multitubular heat exchangers of the prior art and enabling noncondensable gas in the stagnating zones, particularly in a heat exchanger of the large size, to be extracted and removed satisfactorily through the vent tube 12, by causing the stagnating zones to move toward the vent tube 12.

Figure 3:
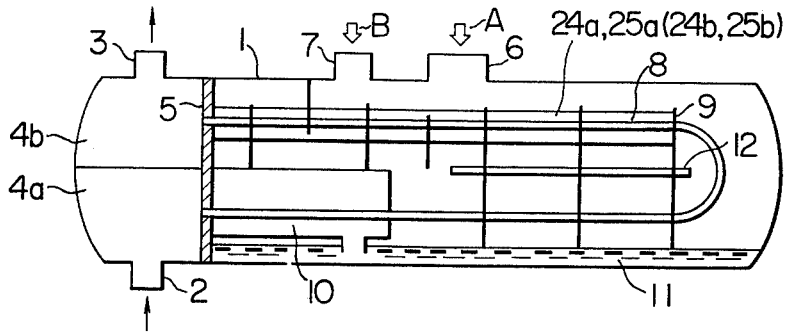
FIG. 3 is a vertical sectional view in explanation of the multitubular heat exchanger of the dual shell type according to an embodiment of the present invention.
Figure 4:
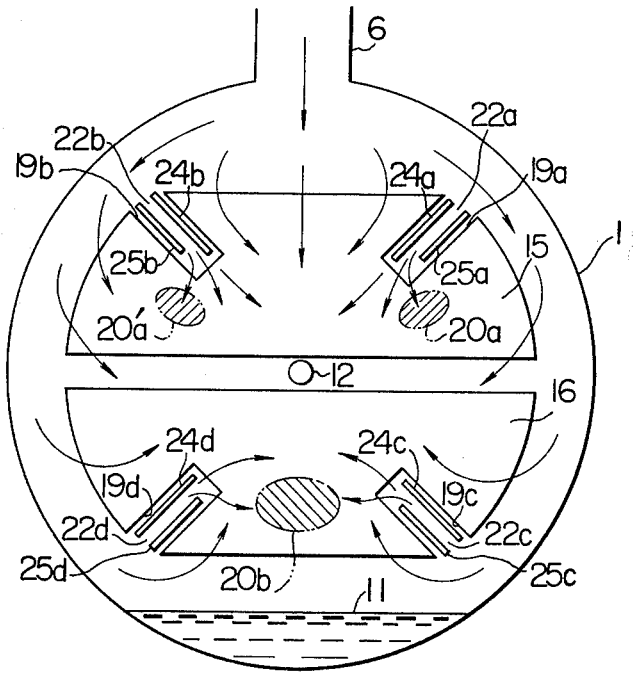
FIG. 4 is a transverse sectional view of the heat exchanger shown in FIG. 3.

FIGS. 3 and 4 show the multitubular heat exchanger of the dual shell type constructed as a feedwater heater, according to an embodiment of the present invention. The heat exchanger shown in FIGS. 3 and 4 is of the same type as that shown in FIGS. 1 and 2 and its shell 1 has installed therein the tube bundles 15 and 16 formed with the slits 19*a* to 19*d*, as is the case with the heat exchanger shown in FIG. 2. As viewed on a transverse sectional surface shown in FIG. 4, the slits 19*a* to 19*d* extend radially inwardly, from those positions on the outer peripheries of the tube bundles 15 and 16 which are spaced apart laterally with respect to the position of the vent tube 12 interposed between the upper and lower tube bundles 15 and 16.

The slits 19*a* and 19*b* formed in the high temperature or upper tube bundle 15 have arranged therein a pair of flow regulating plates 24*a* and 25*a* and a pair of flow regulating plates 24*b* and 25*b* respectively. The flow regulating plates 24*a* and 25*b* are in spaced parallel juxtaposed relation to define therebetween a flow passage 22*a*, while the flow regulating plates 24*b* and 25*b* are in spaced parallel juxtaposed relation to define therebetween a flow passage 22*b*. Likewise, the slits 19*c* and 19*d* formed in the low temperature or lower tube bundle 16 have arranged therein a pair of flow regulating plates 24*c* and 25*c* and a pair of flow regulating plates 24*d* and 25*d* respectively, and the flow regulating plates 24*c* and 25*c* define therebetween a flow passage 22*c* while the flow regulating plates 24*d* and 25*d* define therebetween a flow passage 22*d*. The flow regulating plates are each joined as by welding at opposite ends as viewed axially of the heat exchanger (leftwardly and rightwardly in FIG. 3) to tube support plates 9. Except for the structural arrangement described hereinabove, the embodiment of the invention shown in FIGS. 3 and 4 is of the same construction as the heat exchanger of the prior art shown in FIGS. 1 and 2. In FIGS. 1–4, similar parts are designated by like reference characters.

In the first embodiment shown in FIGS. 3 and 4, the flow passages 22*a*, 22*b*, 22*c* and 22*d* are each closed at opposite lateral sides by a pair of flow regulating plates. By this arrangement, steam flows through each flow passage deep into the central portion of each tube bundle by virtue of the pressure differential between the outside of each tube bundle and the interior thereof, without being dispersed laterally or outwardly of each flow passage midway in its flow. This enables steam energy of steam pressure of high magnitude to be built up at the inner ends of the flow passages 22c and 22d in the low temperature tube bundle 16, thereby forcing the stagnating zone 20b to move to a position near the vent tube 12 which is in a minimum pressure zone. By forcing the stagnating zone to move to a position near the vent tube 12, it is possible to remove stagnating noncondensable steam or gas through the vent tube 12 from the shell 1. Likewise, high steam energy built up at the inner ends of the flow passages 22a and 22b in the high temperature tube bundle 15 enables the stagnating zones 20a and 20a' to be eliminated.

In the embodiment shown and described hereinabove, the flow regulating plates 25a and 25b of the two pairs of flow regulating plates in the high temperature tube bundle 15 disposed on the downstream side of streams of steam have a smaller length than the flow regulating plates 24a and 24b disposed on the upstream side thereof, so that the inner ends of the flow regulating plates 25a and 25b are disposed a little distance short of the inner ends of the flow regulating plates 24a and 24b respectively. By varying the positions of the inner ends of the flow regulating plates 25a and 25b from those of the flow regulating plates 24a and 24b forming a pair with the flow regulating plates 25a and 25b respectively, it is possible to increase the area of outflow of steam at the inner end of each of the flow passages 22a and 22b, thereby enabling the direction of outflow of steam to be adjusted. In the embodiment shown and described hereinabove, the flow regulating plates 25a and 25b disposed on the downstream side of streams of steam have a smaller length than the flow regulating plates 24a and 24b respectively so as to cause steam to flow toward the stagnating zones 20a and 20a' tending to be formed at the back or on the downstream side of the flow passages 22a and 22b respectively. Likewise, the inner ends of the flow regulating plates 25c and 25d of the two pairs of regulating plates in the low temperature tube bundle 16 disposed on the downstream side of streams of steam are disposed a little distance short of the inner ends of the flow regulating plates 24c and 24d respectively disposed on the upstream side of streams of steam. By this arrangement, the stagnating zone 20b can be readily eliminated.

It is to be understood that the number and the position of each flow passage and the length of each flow regulating plate can be suitably selected depending on the position or positions in the shell 1 in which a stagnating zone or zones are likely to be created.

Figure 5:
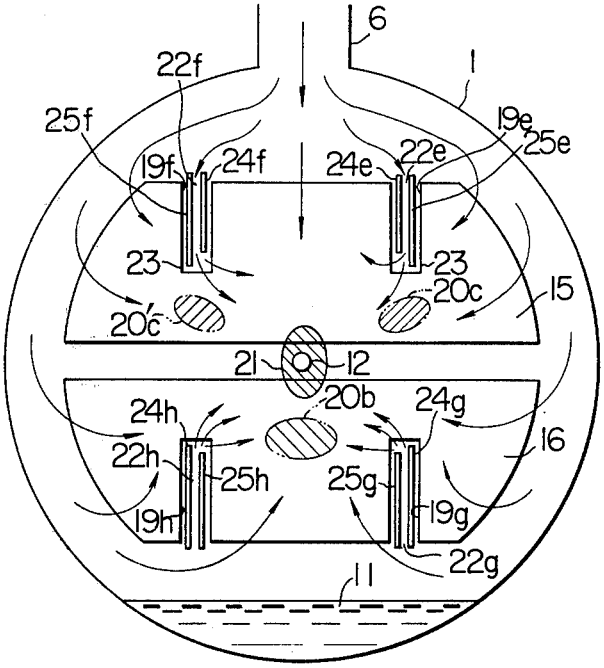
FIG. 5 is a view similar to FIG. 4 but showing the heat exchanger according to a second embodiment.

FIG. 5 shows a second embodiment having slits and flow regulating plates distinct from those of the first embodiment in position and configuration. In other respects, the second embodiment is substantially similar to the first embodiment. More specifically, in the second embodiment, slits 19e and 19f formed in the high temperature tube bundle 15 extend, as viewed on a transverse sectional surface shown in FIG. 5, substantially vertically downwardly from positions at the top of the tube bundle 15 spaced apart horizontally from each other and disposed laterally on opposite sides of the vent tube 12, while slits 19g and 19h formed in the low temperature tube bundle 16 extend substantially vertically upwardly from positions at the bottom of the tube bundle 16 spaced apart horizontally from each other and disposed laterally on opposite sides of the vent tube 12. The slits 19e, 19f, 19g, and 19h have arranged therein pairs of flow regulating plates 24e and 25e, 24f and 25f, 24g and 25g, and 24h and 25h, respectively. The flow regulating plates extend vertically in a manner to correspond to the shapes of the slits, so that the pairs of flow regulating plates each define one of laterally-closed flow passages 22e, 22f, 22g and 22h.

The structural arrangement wherein the slits extend vertically eliminates interference of the inflow of steam to a position corresponding to the stagnating zone 20a in FIG. 2 by the flow regulating plates, thereby offering the advantage that no stagnating zone is created in this position. However, there is the possibility that stagnating zones 20c and 20c' might be produced in positions in the tube bundle 15 having a greater depth than the position of the stagnating zone 20a as measured from the outer periphery of the tube bundle 15 toward the vent tube 12. In the second embodiment, high steam energy is build up at the inner ends of the flow passages 22e and 22f, as in the first embodiment, so that it is possible to force the stagnating zones 20c and 20c' to move toward a position 21 near the vent tube 12.

High steam energy is also built up at the inner ends of the flow passages 22g and 22h formed in the low temperature tube bundle 16, so that it is possible to force the stagnating zone 20b to move to the position 21 near the vent tube 12.

In the second embodiment, of all the flow regulating plates forming pairs, the flow regulating plates 24e, 24f, 25g and 25h near the vent tube 12 or located inwardly of the steam streams flowing through the flow passages 22e, 22f, 22g and 22h respectively have a smaller length than the flow regulating plates 25e, 25f, 24h and 24g remote from the vent tube 12 or located outwardly of the steam streams flowing through the flow passages 22e, 22f, 22g and 22h respectively, so that the inner ends of the flow regulating plates 24e, 24f, 25g and 25h are disposed a little distance short of the inner ends of the flow regulating plates 25e, 25f, 24g and 24h respectively. When the positions in which the stagnating zones 20c, 20c' and 20b would be likely to be formed are taken into consideration, it is desirable that the structural arrangement described hereinabove be adopted to permit steam to flow to the aforesaid positions.

Figure 6:
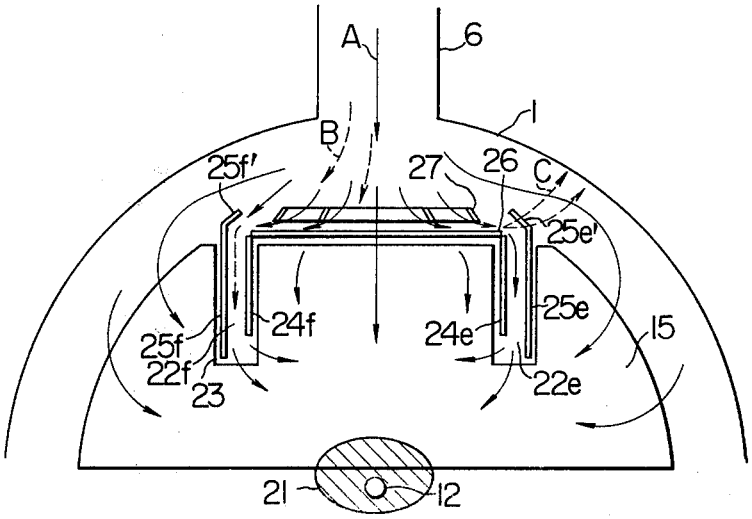
FIG. 6 is a fragmentary transverse sectional view of the heat exchanger according to a third embodiment.

FIG. 6 shows a third embodiment providing an improvement in the second embodiment. As shown, drain separators 25e' and 25f' are provided at the inlet of the flow passages 22e and 22f respectively formed in the high temperature or upper tube bundle 15 for separating drain from steam to permit the drain to be introduced into the flow passages 22e and 22f. More specifically, the drain separators 25e' and 25f' are formed at the top of the flow regulating plates 25e and 25f which cooperate with the flow regulating plates 24e and 24f to define the flow passages 22e and 22f respectively and which are disposed near to a side wall of the shell 1 than the flow regulating plates 24e and 24f, and project upwardly and inwardly toward each other in the shell 1. The numeral 26 in FIG. 6 designates a shock absorbing plate formed of a porous plate and usually mounted in this type of heat exchanger of the prior art. The shock absorbing plate 26 is joined at opposite side edges thereof to the upper ends of the flow regulating plates 24e and 24f and has mounted thereon a known steam guide plate 27.

By the structural arrangement of the third embodiment, drain B contained in steam A introduced through the steam inlet port 6 into the shell 1 impinges on the shock absorbing plate 26. Drain C directed toward the interior of the shell 1 after impinging on the plate 26 impinges on the drain separators 25*e'* and 25*f'* at the upper ends of the flow regulating plates 25*e* and 25*f*, respectively, and flows downwardly through the flow passages 22*e* and 22*f*, thereby making it possible to separate the drain streams from the steam streams flowing around the outer periphery of the tube bundle 15. Thus the embodiment shown in FIG. 6 is capable of achieving the effect of reducing the moisture content of the steam, in addition to the effect of eliminating the stagnating zones described with reference to the second embodiment, thereby further improving the performance of the heat exchanger. Except for the structural arrangement described hereinabove, the third embodiment is substantially similar in construction to the second embodiment. It is to be understood that the drain separators of the third embodiment may be provided to the corresponding flow regulating plates of the first embodiment, without departing from the scope of the invention.

In the embodiments shown and described hereinabove, each flow passage is defined by flow regulating plates forming a pair. It is to be understood that the flow regulating plates may be replaced by a tubular member of rectangular cross section which is mounted in each slit to provide a flow passage.

From the foregoing description, it will be appreciated that the invention provides flow passages leading from the outer periphery of each tube bundle to the interior thereof so as to introduce fluid flowing along the outer peripheries of the heat transmitting tubes to the interior of each tube bundle through the flow passages formed therein. The invention eliminates fluid stagnating zones in the shell by forcing them to move from the tube bundles to the vent tube, thereby increasing the efficiency with which heat exchange is effected. The invention is also capable of reducing the size of the fluid stagnating zones, to thereby improve the thermal efficiency of the heat exchanger by reducing the amount of fluid removed by extraction through the vent tube. The heat exchanger provided by the invention is reduced in number and size of the fluid stagnating zones that would be created therein, thereby enabling the capacity of the heat exchanger to be increased. An additional advantage offered by the invention is that when the invention is incorporated in a heat exchanger using aluminum brass tubes as heat transfer tubes, corrosion of the tubes by the action of ammonia can be avoided.

What is claimed is:

1. In a multitubular heat exchanger comprising a shell, a heating medium inlet formed in said shell, a high temperature tube bundle and a low temperature tube bundle located within said shell and formed by a large number of U-shaped heat transfer tubes for permitting a medium to be heated to flow therethrough so that heat exchange may take place between the medium to be heated and a heating medium introduced into the interior of said shell through said heating medium inlet, and a vent tube interposed between said high temperature tube bundle and said low temperature tube bundle arranged in the longitudinal direction of said shell for removing noncondensable gas therethrough from the interior of the shell, wherein the improvement comprises:

means for defining at least one laterally-closed flow passage in at least one of said tube bundles, said flow passage inducing therethrough part of the heating medium flowing between said shell and said tube bundles to an inner deep portion of said at least one tube bundle.

2. A multitubular heat exchanger as claimed in claim 1, wherein said flow passage defining means comprises at least one slit opening at the outer periphery of said at least one tube bundle and extending toward the interior of the latter tube bundle, and at least one pair of flow regulating plates arranged in said slit for defining therebetween said flow passage.

3. A multitubular heat exchanger as claimed in claim 1 or 2, wherein said flow passage extends, as viewed on a transverse sectional surface of said heat exchanger, radially inwardly from the outer periphery of said at least one tube bundle toward said vent tube.

4. A multitubular heat exchanger as claimed in claim 1 or 2, wherein said flow passage extends, as viewed on a transverse sectional surface of said heat exchanger, in a straight line from the outer periphery of said at least one tube bundle toward a position in the boundary between said two tube bundles displaced from said vent tube.

5. A multitubular heat exchanger as claimed in claim 2, wherein said flow passage defining means is provided in at least said high temperature tube bundle, and said slit and said pair of flow regulating plates extend, as viewed on a transverse sectional surface of said heat exchanger, radially inwardly from the outer periphery of the high temperature tube bundle toward the vent tube, one of said pair of flow regulating plates in the high temperature tube bundle located on the downstream side of streams of the heating medium introduced into said shell having an inner end disposed a little distance short of the inner end of the other of said pair of flow regulating plates disposed on the upstream side thereof.

6. A multitubular heat exchanger as claimed in claim 2, wherein said flow passage defining means is provided in at least said low temperature tube bundle, and said slit and said pair of flow regulating plates extend, as viewed on a transverse sectional surface of said heat exchanger, radially inwardly toward the vent tube from the outer periphery of said low temperature tube bundle, one of said pair of flow regulating plates in said low temperature tube bundle located on the downstream side of streams of the heating medium introduced into said shell having an inner end disposed a little distance short of the inner end of the other of said pair of flow regulating plates disposed on the upstream side thereof.

7. A multitubular heat exchanger as claimed in claim 2, wherein said high temperature tube bundle is located above said low temperature tube bundle in superposed relation, said flow passage defining means is provided in at least said high temperature tube bundle, and said slit and said pair of flow regulating plates extend, as viewed on a transverse sectional surface of said heat exchanger, substantially vertically downwardly into the high temperature tube bundle from the position on the outer periphery of the latter tube bundle displaced laterally from the vent tube, one of said pair of flow regulating plates in the high temperature tube bundle remote from a side wall of the shell having an inner end disposed a little distance short of the inner end of the other of said pair of flow regulating plates near the side wall of the shell.

8. A multitubular heat exchanger as claimed in claim 2, wherein said high temperature tube bundle is located above said low temperature tube bundle in superposed relation, said flow passage defining means is provided in at least said low temperature tube bundle, and said slit and said pair of flow regulating plates extend, as viewed on a transverse sectional surface of said heat exchanger, substantially vertically upwardly into the low temperature tube bundle from the position on the outer periphery of the latter tube bundle displaced laterally from the vent tube, one of said pair of flow regulating plates in the low temperature tube bundle remote from a side wall of the shell having an inner end disposed a little distance short of the inner end of the other of said pair of flow regulating plates near the side wall of the shell.

9. A multitubular heat exchanger as claim in claim 1, wherein said high temperature tube bundle is located above said low temperature tube bundle in superposed relation and said flow passage is provided in at least said high temperature tube bundle and having an inlet portion opening upwardly, and further comprising a drain separator provided at said inlet portion of said flow passage for separating drain from the heating medium flowing across said inlet portion and directed away from said flow passage, to induce the drain to flow into the flow passage.

10. A multitubular heat exchanger as claimed in claim 2, wherein said high temperature tube bundle is located above said low temperature tube bundle in superposed relation, said pair of flow regulating plates are provided in at least said high temperature tube bundle, said flow regulating plates have outer ends located at the upper portion of said high temperature tube bundle spaced from said heating medium inlet laterally toward the side wall of said shell and extending into the interior of the latter tube bundle, said outer ends of said flow regulating plates defining an inlet portion of said flow passage opening upwardly of the high temperature tube bundle; and wherein said heat exchanger further comprises a drain separator plate projecting upwardly from the outer end of one of said pair of flow regulating plates located near the side wall of said shell and being inclined inwardly toward the other of said pair of flow regulating plates, said drain separator plate separating drain from the heating medium flowing across said inlet portion of said flow passage and inducing the drain to flow into said flow passage.

* * * * *